United States Patent [19]

Trumble et al.

[11] 4,013,061

[45] Mar. 22, 1977

[54] IGNITION SYSTEM FOR CHEMICAL HEATERS

[75] Inventors: John H. Trumble, Elm Grove; Thomas C. Ehlert, Wauwatosa; Akos Szekely, Colgate, all of Wis.

[73] Assignee: Thermology, Inc., Milwaukee, Wis.

[22] Filed: Mar. 26, 1975

[21] Appl. No.: 562,352

Related U.S. Application Data

[63] Continuation-in-part of Ser. No. 545,206, Jan. 29, 1975, abandoned.

[52] U.S. Cl. ..... 126/263; 44/40; 149/15

[51] Int. Cl.[2] ..... F24J 1/02

[58] Field of Search ..... 126/263, 390, 367; 165/183; 102/39, 28; 44/38, 40; 252/70; 149/15, 16

[56] References Cited

UNITED STATES PATENTS

| | | | |
|---|---|---|---|
| 1,573,872 | 2/1926 | Schwartz | 126/263 |
| 2,953,443 | 9/1960 | Lloyd | 102/28 |
| 3,160,537 | 12/1964 | Trafton, Jr. | 149/37 |
| 3,874,365 | 7/1974 | Pava | 126/263 |

*Primary Examiner*—John J. Camby
*Assistant Examiner*—Larry I. Schwartz

[57] ABSTRACT

A self-contained heating device useful for a variety of heating applications is disclosed. In a preferred form of the invention a hermetically-sealed cartridge containing a chemical mixture which produces heat, but substantially no gas, upon ignition is disposed in a heating unit which also includes a means for igniting the cartridge and a heat transfer sleeve surrounding the cartridge. Preferably, the chemical mixture comprises an alumino-thermic mixture and the igniting means is a percussion primer cap. To increase the percentage of successful ignitions in such a device, a cone-shaped depression is formed in the alumino-thermic reactive mixture adjacent the percussion cap, which depression is preferably filled with a ignition mixture of finely divided aluminum and $Fe_2O_3$ or $Fe_3O_4$.

8 Claims, 6 Drawing Figures

IGNITION SYSTEM FOR CHEMICAL HEATERS

BACKGROUND OF THE INVENTION

The present invention is a continuation-in-part of commonly assigned U.S. patent application Ser. No. 545,206 filed Jan. 29, 1975 now abandoned, by the present inventors and entitled "Heating Device".

The present invention relates generally to the art of self-contained heating units and in particular to heating units which employ a chemical reaction to produce heat. Several such heaters are disclosed in the prior art for such diverse heating applications as warming foods or liquids, heating shaving water, heating hair curlers, field soldering jobs, etc. However, all such prior art systems suffer from one or more drawbacks which have prevented such systems from receiving commercial acceptance. It would be desirable to have a safe, reliable and efficient heating unit for use when conventional heat sources such as electricity or flame are unavailable and/or dangerous. Military personnel could use such heaters during military manuevers or during wartime to prepare hot meals and drinks. Hunters, fishermen, skiers, campers, etc. would find such devices useful for preparing hot foods in the field, and the homemakers would find many uses for such a heater during power blackouts.

Some prior art heaters have used the "Thermite" reaction as the heat source, which reaction can be represented by either of the following formulas:

$$Fe_2O_3 + 2Al \rightarrow 2Fe + Al_2O_3 + \text{heat}$$

$$3Fe_3O_4 + 8Al \rightarrow 9Fe + 4Al_2O_3 + \text{heat}$$

This reaction, while typically employing aluminum and an oxide of iron, can also involve other metals and other oxides, as is known to the art. The advantage of this reaction is that theoretically no gas is produced during the reaction "burn" since the supporting oxygen is provided by the iron oxide. Prior Thermite heaters have one or more drawbacks such as high toxicity of ignition mixtures which precludes use for heating foods or drinks, the lack of control over the reaction rate and corresponding heat output of the unit, excessive gas pressures in the heating cartridges, etc. A number of patents disclosing a variety of such prior art heaters are discussed in the parent application.

According to the teachings of the parent invention, the efficiency of alumino-thermic reaction heaters can be increased by thermally or chemically controlling the burn rate, utilizing the discovery that the burn time of heating cartridges of this type is dependent not only on the chemical mixture employed, but on the heat conductivity characteristics of the cartridge, and the temperature and heat conductivity characteristics of the substance being heated or any sleeve surrounding the cartridge. Thermal control can be accomplished by dividing the chemical mixture into a plurality of columns and causing a series reaction through one column at a time to increase the burn time, or by providing a plug of inert material at the core of the reactive chemical mixture. Chemical control is accomplished by adjusting the reaction stoichiometry or by adding suitable retardants. Either or both of these techniques has been found to be highly effective in increasing the reaction burn time and maximizing the ability to transfer heat from the cartridge to the surrounding environment.

While the inventions disclosed in the aforementioned application result in self-contained heating units which are useful and which possess numerous advantages over prior heaters, additional attempts have been made to improve the ignition efficiency. When employing tightly packed slugs of alumino-thermic reactive chemicals in a heating cartridge and using primer cap ignition systems, it has been found that in a high percentage of cases the primer flame merely glazes the upper surface of the reactants, in which cases ignition does not result. Prior attempts to overcome this problem included using highly reactive ignition mixtures overlying the main body of chemicals, such as a mixture of barium and magnesium oxide. However, such ignition mixtures are toxic and their use in heaters designed for food or drink applications is to be avoided. An ignition system which overcomes these problems would be a significant advance in this technology.

OBJECTS OF THE INVENTION

It is a primary object of the present invention to provide an ignition system for chemical heaters which permits a high percentage of successful ignitions.

Another object of the present invention is to provide an ignition system for chemical heaters which avoids the use of toxic chemicals.

A further object of the present invention is to provide an ignition system for chemical heaters which does not add substantially to manufacturing cost.

A still further object of the present invention is to provide an ignition system for chemical heaters which is adaptable to cartridge designs employing the technique of thermal retardation.

How these and other objects of the present invention are accomplished will be described in the following specification taken in conjunction with the FIGURES. Generally, however, the invention comprises providing a self-contained heating device consisting of a percussion ignition system, a hermetically-sealed cartridge containing a quantity of reactive chemical materials and a sleeve surrounding the cartridge. In a preferred form the cartridge contains an alumino-thermic mixture in the form of a tightly compressed slug. The slug includes a cone-shaped depression at the area thereof adjoining the percussion cap ignition means. A lightly packed quantity of aluminum and $Fe_2O_3$ or $Fe_3O_4$ or other suitable ignition mixtures is then placed in the cone-shaped depression.

DESCRIPTION OF THE PREFERRED EMBODIMENT

Figure 1:
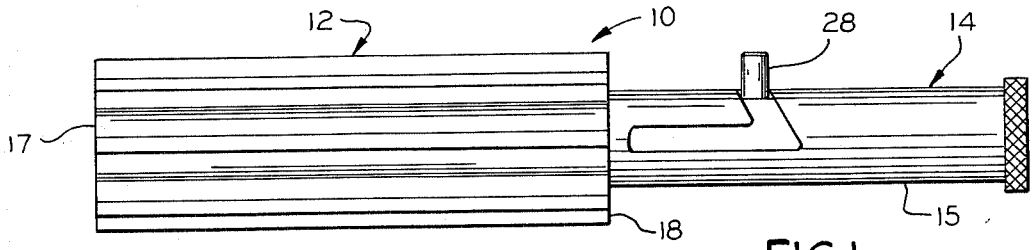
FIG. 1 is a side view showing the sleeve and ignition mechanism of a preferred embodiment of a heating device according to the present invention and showing the firing pin in cocked position.
Figure 2:
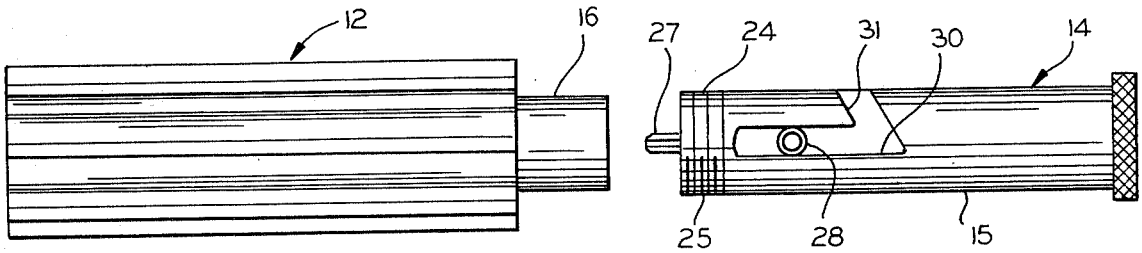
FIG. 2 is a disassembled side view showing the sleeve, cartridge and ignition components of a preferred embodiment of the present invention, with the firing pin in the released position.

FIG. 1 shows a fully assembled heating device 10 according to a preferred form of the present invention to include a sleeve 12 and firing pin unit 14 releasably secured thereto. Contained within sleeve 12, and partially removed and visible in FIG. 2 is a heating cartridge 16 for containing a quantity of heat producing reactive chemicals.

Sleeve 12 is a hollow member having a tubular wall 13 closed at its first end 17 and open at its other end 18 for receivably engaging firing pin unit 14. Sleeve 12 serves to conduct heat from cartridge 16 to the substance to be heated and accordingly is preferably constructed from a heat conductive material such as aluminum, copper, carbide steel, stainless steel and the like. Sleeve 12 may also be constructed from non-metallic materials such as porcelain. The illustrated embodiment of sleeve 12 is shown to include eight equally spaced longitudinal fins 19 running from end 17 to end 18 of the sleeve, radiating outwardly from wall 13 and provided for increasing the effective heat exchange surface of sleeve 12.

Alternate embodiments for sleeve 12 are within the scope of the invention and may be selected by those skilled in the art. Holes can be drilled through the sleeve to increase the surface area for heat conduction, or transverse fins may be employed instead of the longitudinal fins 19 shown in the FIGS. Moreover, the sleeve may be coated with an easily cleanable material such as "Teflon" or other materials known to the "non-stick cooking" art.

The internal portion of wall 13 adjacent end 18 is threaded for receivably engaging threads 24 at end 25 of firing pin unit 14. Other attachment means may be employed for securing the firing pin mechanism to sleeve 12 in a gas-tight manner. Firing pin unit 14 includes a hollow tubular body 15 for containing a spring-loaded firing pin 27 and a trigger catch pin 28. In the disclosed embodiment a spring (not shown) forces the firing pin to the position shown in FIG. 2 against a firing pin seat (also not shown) which closes end 25 except for a small hole in its middle. By retracting trigger catch pin 28 along slot 30 which runs longitudinally of the axis of firing pin mechanism 14, the firing pin 27 is retracted through the firing pin seat into body 15. Trigger catch pin 28 can be locked in the ready position for example, by sliding it into an angular portion 31 of slot 30. The firing pin mechanism has not been described in detail because such mechanisms, in and of themselves, are well known. For example, reference is made to U.S. Pat. No. 1,826,562, issued to Minto on Oct. 6, 1931 for a "Gas Gun".

The firing pin unit 14 may be constructed of any suitable material, but since large amounts of heat are generated by cartridge 16 it is desirable to construct unit 14 from a relatively non-conductive material or alternatively to coat the unit 14 with a heat insulating material to allow the user to safely handle the device.

Heating cartridge 16 comprises a hollow cylindrical casing closed at one end 34 such as by plug 35 (or the body 15 can be a drawn tube) and closed at its opposite end by a percussion primer cap 36. Suitable percussion caps are commercially available from any of several munition manufacturers in the United States and for no part of the present invention. Cartridge 16 in one form is constructed from a steel tube approximately 3 inches in length, 0.625 inches in diameter with a wall thickness of 0.050 inches. Stainless steels are suitable for constructing the cartridge, but other high temperature resistant materials such as other metals or porcelain may be used. Great strength is not a prerequisite for the materials used in constructing cartridge 16 as little gas is produced during the reaction.

Figure 3:
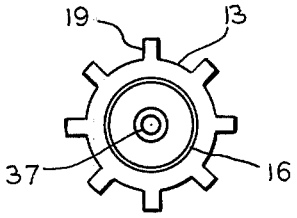
FIG. 3 is an end view showing the sleeve of FIGS. 1 and 2 containing a heating cartridge as shown in FIG. 2.

FIG. 3 illustrates a cartridge 16 disposed within sleeve 12 and shows that the percussion cap 36 is disposed adjacent the open end of sleeve 12. It can also be noted from FIG. 3 that cartridge 16 is slidably disposed within sleeve 12 to avoid cartridge or sleeve rupture resulting from differences in the coefficients of thermal expansion of the cartridge and the surrounding sleeve. The clearance may be 0.10 inches, for example.

While the present invention relates primarily to an ignition enhancing system for the chemicals within cartridge 16 and for use with primer igniters, the ignition system may be used with other igniters such as chemical and electrical igniters. In a typical chemical igniter system, separate quantities of highly reactive chemicals would be disposed at or near the surface of the ignition area within cartridge 16 and some means provided for bringing the highly reactive chemicals together to create sufficient heat to ignite the chemicals. Alternatively, electric igniters can be used wherein leads from a suitable power source are embedded at the upper surface of the ignition mixture. While such ignition systems are frequently employed in related heating device, and are useful according to the present invention, the remaining portion of the description will be directed to heating cartridges with percussion ignition primer caps.

Dealing next with the chemicals to be used in heating cartridge 16, it has been found that the preferred reactive mixture when considering cost, toxicity, heat output and safety is a mixture of aluminum, iron oxide and one or more suitable retardant materials. As mentioned previously, other metal and oxide materials can be employed in the basic Thermite reaction in place of the aluminum and iron oxide. Furthermore, the iron oxide may be $Fe_2O_3$, $Fe_3O_4$ or a mixture thereof. In the preferred embodiment of the present invention the chemical mixture is selected from those comprising 0.75 to 1.25 parts-by-weight aluminum, approximately 1.50–3.50 parts-by-weight of an iron oxide and between 0.25 and 2.50 parts-by-weight of a suitable retardant, such as a 1-2-0.5 mixture of such ingredients. The reaction rate and heat output of a given weight of reactants can vary widely by varying the stoichiometry within these ranges. Anhydrous chemicals (or as nearly anhydrous as practical from a cost standpoint) are preferably employed to avoid generation of steam, hydrogen or other gases during the reaction. The retardant of diluent may be selected for such materials as clay, silica, sand, alumino-oxide, graphite, MgO, $TiO_2$, etc. Diluents are to be avoided which release gaseous products when heated to the high internal temperature in cartridge 16. The chemical mixture is compressed within cartridge 16 at a pressure ranging from 500 to 20,000 psi or more to yield a tightly compressed slug which generates little gas on ignition and burning.

Figure 4:
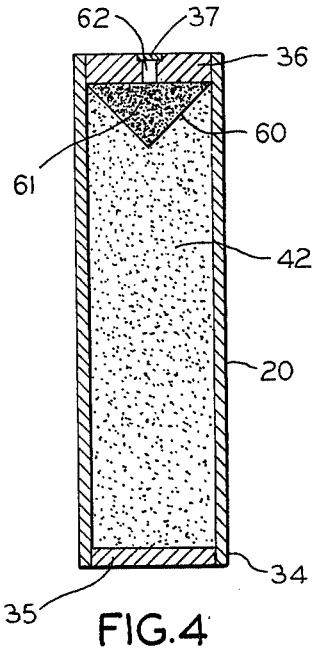
FIG. 4 is a cross-section of one form of heating cartridge according to the present invention.

FIG. 4 illustrates in a simple form the ignition system of the present invention. The slug 42 of reactive chemicals substantially fills cartridge 16 except for a cone-shaped depression 60 at its upper surface. Preferably, the distance from the apex of the cone to the percussion cap 36 is approximately ⅜ in. Variations, of course, from this distance are within the scope of the invention and such distance may be varied depending on the overall size of heating cartridge 16 and the type of percussion cap 36 which is employed. The cone 60 can be formed in slug 42 by the packing rod used to compress the mixture within cartridge 16 or may be formed in any other suitable manner. Within cone 60 is a lightly compressed mixture 61 of a one-to-three mixture of 325 mesh aluminum and $Fe_2O_3$ to substantially fill cartridge 16. Other ignition mixtures may be selected from those ignition mixtures which are capable of burning in an enclosed atmosphere at a temperature sufficient to ignite slug 42 and which are themselves more easily ignitable than slug 42. Non-toxic reactants are preferred, but toxic ignition materials such as barium and magnesium oxide may be used for certain applications.

The success resulting from the use of the cone ignition system is believed to be tied to the discovery that when a typical percussion cap is set off, a flame exits the bottom of the percussion cap to strike the charge below. The cap 36 shown in FIG. 4 includes a charge 37 disposed above an opening 62 in primer cap 36. High speed photography of the primer explosion indicates that a flame from the charge 37 travels through opening 62 into the body of cartridge 16 which flame has a tendency to merely glaze tightly compressed slugs of Thermite mixtures. As mentioned in the discussion of the prior art, devices are known which employ loosely packed mixtures of barium oxide and magnesium above the main body of Thermite reactants, but it is believed that the primer flame tends to merely blow such reaction mixtures aside to glaze the surface of the Thermite.

First attempts at overcoming such problems included modifications of the percussion caps in an attempt to spread the flame leaving the charge 37 over a larger surface area. Such experiments did not result in substantial increases in the percentage of ignitions. However, using cone 60 at the upper surface of the main body of reactants and the ignition mixture 61 disclosed herein, conventional primers have been used to ignite 300 consecutive cartridges without a single ignition failure. The flame from charge 37 travels through opening 62 in the cap and ignites the ignition mixture 61 which in turn ignites the remaining portion of slug 42.

Also within the scope of the present invention is the discovery that the ignition system works most effectively if the area of slug 42 adjacent cone 60 is packed at a lower pressure than is used for the main portion of slug 42. For example, the main portion of slug 42 may be compressed at a pressure of 500–20,000 psi and additional Thermite reactants added to cartridge 16, the latter then being packed at a pressure up to 2,000 psi to form the cone 60.

The effectiveness of the present invention is evidenced by comparative tests using the cartridge shown in FIG. 4 and a cartridge otherwise identical thereto except for the cone-shaped depression 60 in slug 42. In the test cartridges the slug 42 was packed to a depth of approximately 7/16 in. from the percussion cap and 6/16 in. of this distance was filled with a lightly packed quantity of ignition mixture 61. Tests resulted in less than 50 percent successful ignitions.

Figure 5:
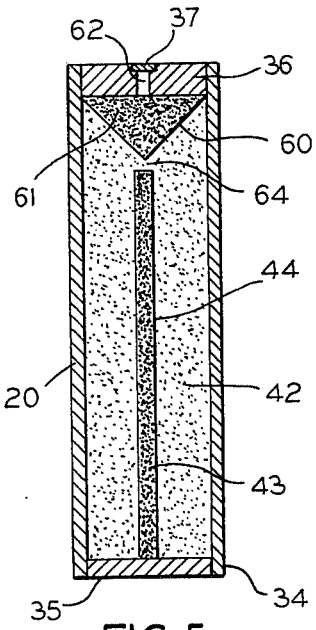
FIG. 5 is a cross-section of another form of heating cartridge according to the present invention.
Figure 6:
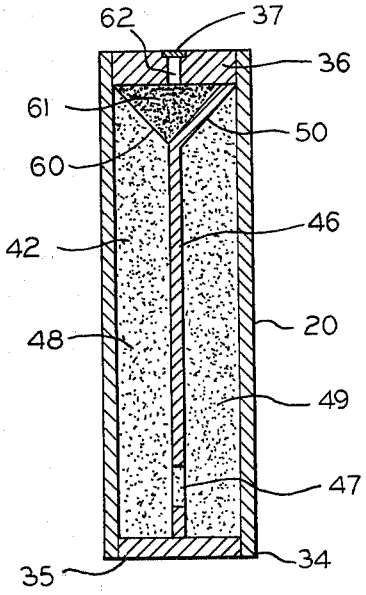
FIG. 6 is a cross-section of yet another form of heating cartridge according to the present invention.

As disclosed in the parent application, it has been discovered that absent thermal or chemical retardation of the burn rate of heating cartridge 16, the heat is generated so quickly that heat may be wasted by boiling liquids into which the heat device 10 is inserted or by scorching or burning the substance to be heated. The parent application describes two techniques for thermally retarding the burn rate in addition to stoichiometric variation of the reactio chemistry. FIGS. 5 and 6 illustrate the combination of the thermal retardation technique and the cone ignition system of the present invention. In FIG. 6, a hole 43 is provided at the core of slug 42, and the hole is filled with a nonreactive material such as 240 mesh silica. Upon ignition of such a cartridge the primary reaction mixture will burn down the length of cartridge 16 to provide a slow release of the potential heat of reaction of material 42. The size of the hole will vary depending upon the heat conductivity parameters of cartridge 16 and sleeve 12 and is preferably 1/16 in. to ⅛in. using the finned aluminum sleeve 12 illustrated in FIGS. 1–3. The cone 60 is disposed above the core 43 and spaced apart therefrom by a layer of reactants 64 which is of the same composition or slug 42. Upon ignition of charge 37, the flame will ignite mixture 61, the layer of reactive chemicals 64 between the ignition mixture 61 and the core 44, and finally the donut-shaped slug 42 of thermite reactants.

FIG. 6 shows another embodiment of a heating cartridge 16 useful in the present invention. Here however, a different method is employed to thermally retard the burn of the alumino-thermic slug 42. Cartridge 16 is divided into separate burn chambers 48 and 49 such as by a vein 46. A single metallic vein 46 is disposed in the center of cartridge 16, which has a hole 47 in the lower end thereof for permitting the burning alumino-thermic material to pass from a first side 48 of cartridge 16 to the other side 49. The vein is deflected at its upper end 50 to form a first portion of cone 60. Upon ignition of percussion cap 36 in this embodiment, the flame from charge 37 travels through opening 62 to the ignition mixture 61 which in turn ignites the slug 42 at side 48 of the cartridge. The deflection 50 in view 46 may be formed by using a cone-shaped die or the vein may be preformed and inserted into slug 42. Representative examples of modifications of this thermal retardation technique are disclosed in the parent application.

The foregoing description of the preferred embodiments of the invention demonstrate that it is possible to chemically and thermally retard the alumino-thermic reaction to the point where maximum efficiency of heat transfer is achieved. By reducing the external temperature of sleeve 12, steaming or boiling of the surface of sleeve 12 is reduced, thereto, eliminating possible injury from splattering of hot liquids and insuring the maximum temperature rise for the substance being heated. In addition, by employing ignition mixture 61 in the cone-shaped configuration disclosed herein, maximum ignition efficiency is achieved. So while the invention has been described with reference to particular preferred embodiments, it is not to be limited thereby but is to be limited solely by the claims which follow.

We claim:

1. A heating unit consisting essentially of:

a hollow hermetically sealed thermo-conductive container, a quantity of a reactive chemical mixture disposed within and substantially filling said container, said chemical mixture consisting essentially of 0.75–1.25 parts-by-weight aluminum, approximately 1.5–3.5 parts-by-weight of an iron oxide and additionally comprises 0.25–2.50 parts-by-weight of an inert finely divided material, a cone-shaped quantity of a chemical ignition mixture consisting of aluminum and a material selected from the group consisting of $Fe_2O_3$ and $Fe_3O_4$ disposed within said container, said quantity having a base portion and an apex, said base portion being disposed adjacent an interior surface of said container least the apex being embedded in said reactive mixture, ignition means for igniting the base portion of said ignition mixture.

2. The invention set forth in claim 1 wherein said ignition mixture comprises approximately 1 part-by-weight aluminum and approximately 3 parts-by-weight $Fe_2O_3$.

3. A heating cartridge for chemical heaters comprising:

a cylindrical, heat-conductive shell closed at a first end, a primer ignition cap means closing the other end of said cartridge to form a hermetically sealed shell, a quantity of a chemical reaction mixture disposed within said shell, said chemical mixture consisting essentially of 0.75–1.25 parts-by-weight aluminum, approximately 1.5–3.5 parts-by-weight of an iron oxide and additionally comprises 0.25–2.50 parts-by-weight of an inert finely divided material, said quantity substantially filling said shell and including a coneshaped depression adjacent said ignition cap means, and a quantity of a chemical ignition mixture substantially filling said depression. and consisting of aluminum and a material selected from the group consisting of $Fe_2O_3$ and $Fe_3O_4$ , said ignition mixture being more easily ignitable by said ignition means than said reactive mixture and producing sufficient heat after ignition to ignite said reactive mixture.

4. The invention set forth in claim 3 wherein said ignition mixture comprises approximately 1 part-by-weight aluminum and approximately 3 parts-by-weight $Fe_2O_3$.

5. The invention set forth in claim 3 wherein said quantity of said reactive chemical mixture is compressed at a higher pressure at the portion thereof adjacent said first end of said shell than at the portion thereof adjacent said cone-shaped depression.

6. A chemical heating cartridge comprising:

a metallic cylindrical shell closed at a first end, a percussion primer cap closing the second end of said shell, a slug of alumino-thermic materials substantially filling said shell except for a cone-shaped depression therein adjacent said primer cap, said alumino-thermic material being a mixture of finely divided chemicals comprising approximately 0.75–1.25 parts-by-weight aluminum approximately 1.5–3.5 parts-by-weight of an iron oxide selected from the group consisting of $Fe_2O_3$ and $Fe_3O_4$ and approximately 0.25–2.50 parts-by-weight of an inert material, said slug being compressed at a pressure of 500–20,000 psi, and a cone-shaped quantity of a chemical ignition mixture disposed in said depression and comprising a mixture of aluminum and $Fe_2O_3$, said ignition mixture being compressed into said depression at a pressure less then that used to compress said chemical mixture.

7. The invention set forth in claim 6 wherein that portion of said alumino-thermic slug adjacent said first end is compressed at a higher pressure than that portion thereof adjacent said cone-shaped depression.

8. The invention set forth in claim 7 wherein said ignition mixture comprises approximately 1 part-by-weight aluminum to 3 parts-by-weight $Fe_2O_3$.

* * * * *